US005635890A

United States Patent [19]

Yamaguchi et al.

[11] Patent Number: 5,635,890

[45] Date of Patent: Jun. 3, 1997

[54] CHOKE COIL

[75] Inventors: Kouichi Yamaguchi, Fukui-ken; Iwao Fukutani; Takaaki Ooi, both of Takefu; Tatsuyuki Yamada, Fukui-ken, all of Japan

[73] Assignee: Murata Manufacturing Co., Ltd., Nagaokakyo, Japan

[21] Appl. No.: 597,463

[22] Filed: Feb. 2, 1996

[30] Foreign Application Priority Data

Feb. 3, 1995 [JP] Japan ..... 7-017160
Feb. 6, 1995 [JP] Japan ..... 7-018076

[51] Int. Cl.[6] ..... H01F 17/06; H01F 27/30

[52] U.S. Cl. ..... 336/83; 336/212; 336/215; 336/233

[58] Field of Search ..... 336/83, 212, 214, 336/215, 233, 234

[56] References Cited

U.S. PATENT DOCUMENTS 2,015,674 10/1935 Hayes ..... 336/83

5,506,559 4/1996 Yamagochi ..... 336/83

*Primary Examiner*—Thomas J. Kozma

*Attorney, Agent, or Firm*—Burns, Doane, Swecker & Mathis, LLP

[57] ABSTRACT

A choke call includes a bobbin, a pair of windings wound around the bobbin, and two magnetic cores. The bobbin has a rectangular barrel in which a circular hole is defined. The two magnetic cores are partly inserted into the hole of the barrel. The hole is offset from the central axis of the barrel. A central collar extends perpendicular to and at the central portion of the barrel. Two end collars extend beyond and parallel to opposite ends of the barrel. The thickness of the central collar is approximately two times greater than that of the end collars. The magnetic cores collectively form an opening. Within the opening, the gap between the outer periphery of the central collar and the magnetic cores is greater than that between the outer periphery of the end collars and the magnetic cores. A part of the magnetic cores within the hole has a circular or rectangular cross-section.

7 Claims, 8 Drawing Sheets

CHOKE COIL

BACKGROUND OF THE INVENTION

1. Field of the Invention

The present invention relates to a choke coil designed to eliminate noise generated particularly by an electronic device.

2. Description of the Related Art

There are two modes for circulating noise. One is a normal mode (a differential mode) which circulates noise by generating a voltage difference between power supply lines. The other is a common mode which circulates noise by generating a voltage difference between the power supply lines and ground, but without a voltage difference between the power supply lines. The noise current direction of the normal mode is in the same direction as the current direction of the power supply. The noise current direction of the common mode follows a different loop than the current of the power supply. Choke coils are designed to reduce or eliminate these types of noise.

Generally, a common mode choke coil has a slight normal mode leakage inductance and is thus effective to eliminate a normal mode noise to some extent. However, a separate normal mode choke coil is required in the event that a strong normal mode noise occurs.

Some common mode choke coils have a relatively large normal mode leakage inductance. In such a case, a leakage magnetic flux may have a detrimental effect on peripheral circuits. It is thus necessary to provide a magnetic shield around this type of common mode choke coil.

A conventional choke coil by alone is unable to sufficiently eliminate both common and normal mode noises. To this end, two different choke coils, that is, a common mode choke coil and a normal mode choke coil, conventionally needed to be mounted to a printed circuit board. However, two coils occupy more space than the single coil.

Also, the provision of the magnetic shield brings about a rise in the cost of the choke coil.

Accordingly, it is an object of the present invention to provide a choke coil, which is effective to sufficiently eliminate both common and normal mode noises.

SUMMARY OF THE INVENTION

In order to achieve the above object, the present invention provides a choke coil, which comprises:

(a) a pair of windings;

(b) a bobbin including;

a barrel around which the pair of windings are wound, the barrel including a hole through which a magnetic core can be inserted, two opposite end collars extending beyond and in the same plane as opposite ends of the barrel, a central collar extending around and perpendicular to a central portion of the barrel, a cover for inter-connecting the central collar and two opposite end collars, wherein the bobbin is made of a magnetic material for forming closed magnetic circuits around the pair of windings by the barrel, the collars, and the cover; and (c) a magnetic core for forming a closed circuit having one side inserted into the hole of the barrel.

The choke coil, is characterized in that the cross-section of the hole of the barrel is different from the cross-section of the one side of the magnetic core inserted within the barrel, wherein one has a circular cross-section and the other has a rectangular cross-section.

The choke coil, is characterized in that the hole of the barrel is offset from a central axis of the barrel.

The choke coil, is characterized in that the thickness of the central collar is at least two times greater than that of the end collars.

The choke coil, is characterized in that the magnetic core defines an opening, and within the opening, the gap between the outer periphery of the central collar and the magnetic core is greater than the gap between the outer periphery of the end collars and the magnetic core.

The choke coil, is characterized in that the central collar of the bobbin has a groove on its outer periphery, and a cover has a projection, at least part of which is received in the groove.

In the choke coil, when a common mode noise current flows through the two windings, magnetic fluxes are generated in the respective windings. These magnetic fluxes combine and are converted into thermal energy in the form of eddy current loss within the magnetic core. A decrease in the magnitude of the magnetic fluxes results in removal of a common mode noise. When a normal mode noise current flows through the two windings, the resulting magnetic fluxes are circulated through the closed magnetic circuits of the bobbin. The magnetic fluxes are then converted into thermal energy in the form of eddy current loss. This results in removal of a normal mode noise.

In the choke coil, the cross-section of the hole in the bobbin and the cross-section of the one side of the magnetic core are circular and rectangular, thereby, reducing the contact area between the magnetic core and the inner wall between the magnetic core and the bobbin and, thus, preventing the magnetic fluxes generated within the bobbin due to a normal mode noise from leaking from the bobbin and moving toward the magnetic core.

In the choke coil, due to the offset hole, the part of the barrel within the opening of the magnetic core is thin, whereas a part of the barrel outside of the opening is thick. Thus, the bobbin occupies less space within the opening of the magnetic core. This makes it possible to increase the number of turns of the windings and, thus, the normal and common mode inductances. Also, the magnetic circuits of the bobbin have a larger cross-sectional area outside of the opening of the magnetic core. An increase in the cross-sectional area of the magnetic circuits results in a decrease in magnetic resistance in the magnetic circuits and an increase in the normal mode inductance.

In the choke coil, the central collar has a thickness at least two times greater than that of the end collars. This configuration increases the cross-sectional area of magnetic circuits through which both magnetic fluxes, generated in the respective windings due to a normal mode noise, pass and thus increases normal mode inductance.

In the choke coil, within the opening of the magnetic core, the gap between the outer periphery of the central collar and the magnetic name is greater than the gap between the outer periphery of the end collars and the magnetic core. This arrangement causes magnetic resistance between the outer periphery of the central collar and the magnetic core to be greater than the magnetic resistance between the outer periphery of the end collars and the magnetic core. As a result, the magnetic fluxes generated within the bobbin due to the normal mode current are unlikely to leak from the bobbin and move toward the magnetic core.

In the choke coil, the groove of the central collar is shaped to receive at least part of the projection of the cover. Engagement of the projection and the recess allows for smooth guidance of the cover and facilitates positioning of the cover when the cover is joined to the outer end of the collars. The groove increases the creeping distance between the pair of windings wound around the barrel.

BRIEF DESCRIPTION OF THE DRAWINGS

The present invention will now be described by way of example with reference to the accompanying drawings, in which.

DESCRIPTION OF THE PREFERRED EMBODIMENTS

A choke coil according to one embodiment of the present invention will now be described with reference to the accompanying drawings.

Figure 1:
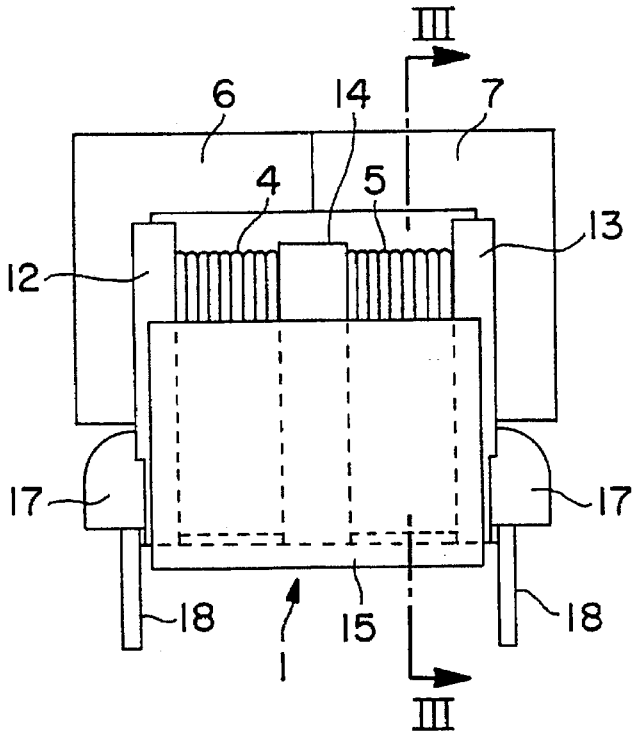
FIG. 1 is a front view of a choke coil according to one embodiment of the present invention.
Figure 2:
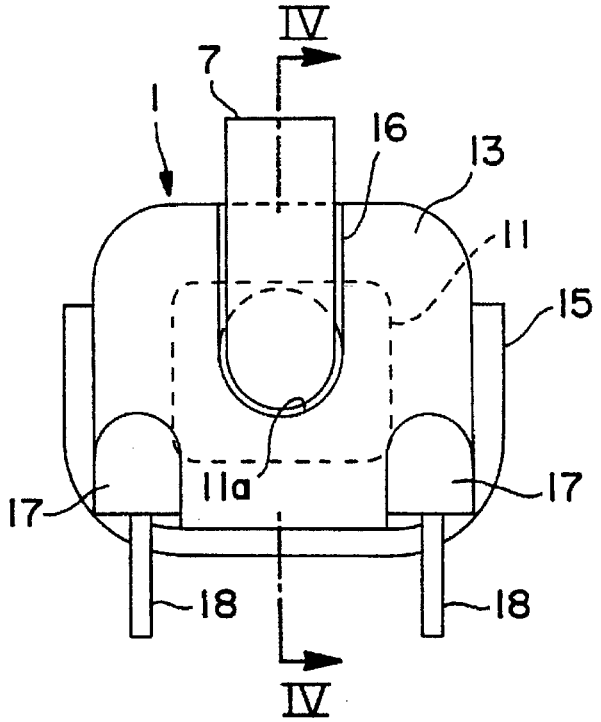
FIG. 2 is a side view of the choke coil shown in FIG. 1.

Referring to FIGS. 1 and 2, a choke coil includes a bobbin 1, a pair of windings 4 and 5 both wound around the bobbin 1, and two C-shaped magnetic cores 6 and 7. The bobbin 1 includes a barrel 11 with three collars, that is, a central collar 14, and two opposite end collars 12 and 13, and a cover 15 attached to peripheral portions of the collars 12 to 14. The barrel 11 has a rectangular cross-section. There is a limit on the size of the choke coil, but the barrel 11 is designed to maximize its cross-sectional area. This design increases the cross-sectional area of a magnetic circuit through which a magnetic flux, which is generated within the bobbin 1 due to a normal mode noise, passes, and thus decreases magnetic resistance in the magnetic circuit so as to provide a larger normal mode inductance.

The barrel 11 has a hole 11*a*. The hole 11*a* is offset upwardly from the axis of the barrel 11 and has a circular cross-section. A magnetic core guide slot 16 is formed in an upper portion of each of the collars 12 and 13. A terminal mount 17 is attached to the lower portion of the collars 12 and 13. A terminal 18 has a part embedded in each terminal mount 17.

The cover 15 has a U-shaped cross-section. The cover 15 is adhesively attached or otherwise secured to the end of the collars 12 to 14 after the windings 4 and 5 have been wound around the barrel 11.

The bobbin 1 is made of an insulating magnetic material, specifically, a ferrite material such as Ni—Zn or Mn—Zn and a dust core. The relative permeability of the material is at least one (preferably, 2 to a few hundred).

The pair of windings 4 and 5 are wound around the bobbin 1 at opposite ends of the collar 14 and have respective leading and tail ends connected to different terminals 18.

The magnetic cores 6 and 7 extend through the hole 11*a* of the barrel 11 and are interconnected together. The magnetic cores 6 and 7 have a C shape. The magnetic cores 6 and 7 are guided by the magnetic core guide slots 16 and oriented in a vertical direction. The cover 15 is attached to one side of the collars 12 to 14 opposite to the magnetic cores 6 and 7. The magnetic cores 6 and 7 are made of a ferrite or amorphous material whose relative permeability is preferably two to three thousand.

The choke coil of this embodiment will be described in more detail with reference to FIGS. 3 and 4.

An opening 8 is defined in the magnetic cores 6 and 7. The thickness $t_1$ of a portion of the barrel 11 within the opening 8 is less than the thickness $t_2$ of a portion of the barrel 11 outside of the opening 8 since the hole 11*a* is offset relative to the barrel 11. Thus, the bobbin 1 occupies less space within the opening 8 of the magnetic cores 6 and 7. This brings about an increase in the number of turns of the two windings 4 and 5 wound around the barrel 11 and, thus, the extent of normal and common mode inductances. Outside of the opening 8, such an arrangement increases the cross-sectional area of the magnetic circuit of the bobbin 1 and, thus, decreases magnetic resistance in the magnetic circuit. This results in an increase in the normal mode inductance.

Figure 3:
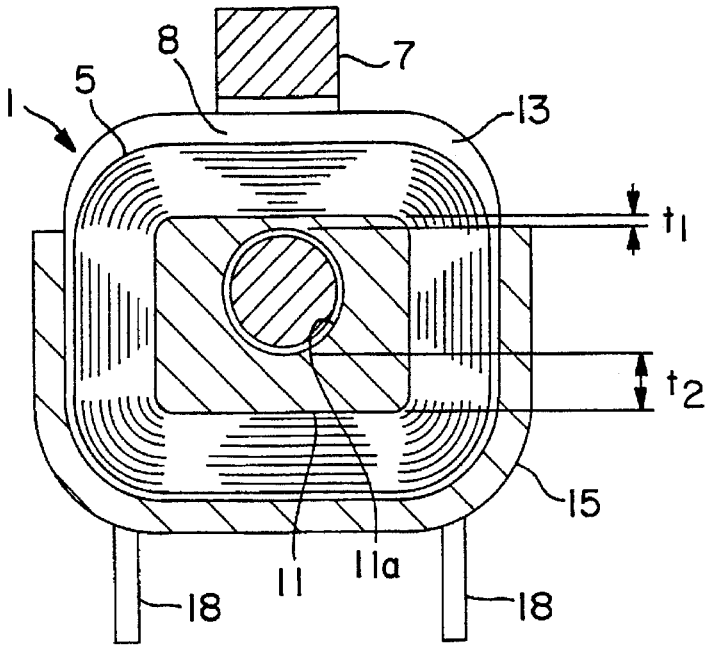
FIG. 3 is a sectional view taken on the line III—III of FIG. 1.

The hole 11*a* is offset in one direction relative to the barrel 11 as shown in FIG. 3. Alternatively, the hole 11*a* may be offset in two different directions, that is, in oblique directions from the axis of the barrel 11.

Figure 4:
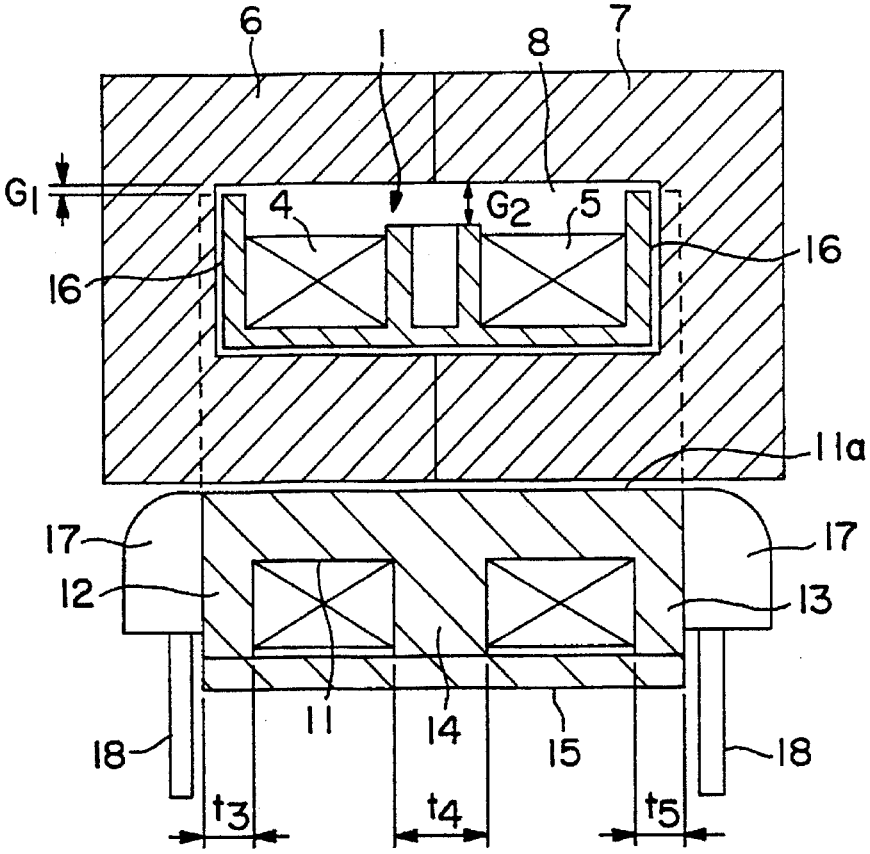
FIG. 4 is a sectional view taken on the line IV–IV of FIG. 2.

Referring to FIG. 4, the left half of the barrel 11, the left end collar 12, the left half of the cover 15, and the central collar 14 collectively form a closed magnetic circuit which extends through the winding 4. The right half of the barrel 11, the right end collar 13, the right half of the cover 15, and the central collar 14 collectively form another closed magnetic circuit which extends through the winding 5. The thickness $t_4$ of the central collar 14 is approximately two times greater than the thickness $t_3$ of the left end collar 12 and the thickness $t_5$ of the right end collar 13. The magnetic circuit of the central collar 14 is greater in cross-section than those of the other collars since both magnetic fluxes $\phi 3$, and $\phi 4$ pass therethrough (see FIG. 9). These magnetic fluxes are generated in the windings 4 and 5 due to a normal mode noise. The central collar 14 thus provides a normal mode inductance.

Also, the central collar 14 does not extend as far into the opening 8 as the end collars 12 and 13. The gap $G_2$ between the outer periphery of the central collar 14 and the magnetic cores 6 and 7 is greater than the gap $G_1$ between the outer periphery of the end collars 12 and 13 and the magnetic cores 6 and 7. Thus, the magnetic resistance between the end of the central collar 14 and the magnetic cores 6 and 7 is greater than the magnetic resistance between the end of the end collars 12 and 13 and the magnetic cores 6 and 7. By this arrangement, the magnetic fluxes $\phi 3$ and $\phi 4$ are less likely to leak from the bobbin 1 and move toward the magnetic cores 6 and 7. This prevents saturation of the magnetic cores 6 and 7 and insures effective removal of the common mode noise.

The magnetic cores 6 and 7 have a circular cross-section and are smaller in diameter than the hole 11*a* of the bobbin 1. This design minimizes the contact area between the magnetic cores 6 and 7 and the inner wall of the hole 11*a* to thereby prevent the magnetic fluxes $\phi 3$ and $\phi 4$ from leaking from the bobbin 1 and moving toward the magnetic cores 6 and 7 and avoid saturation of the magnetic cores 6 and 7.

Figure 5:
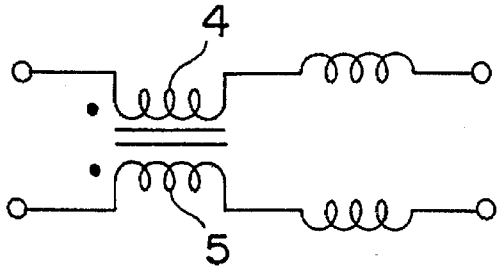
FIG. 5 illustrates an electric equivalent circuit for use in the choke coil shown in FIG. 1.

With this arrangement, the choke coil is effective to sufficiently eliminate both common and normal mode noises. FIG. 5 shows an electric equivalent circuit for use in the choke coil.

Figure 6:
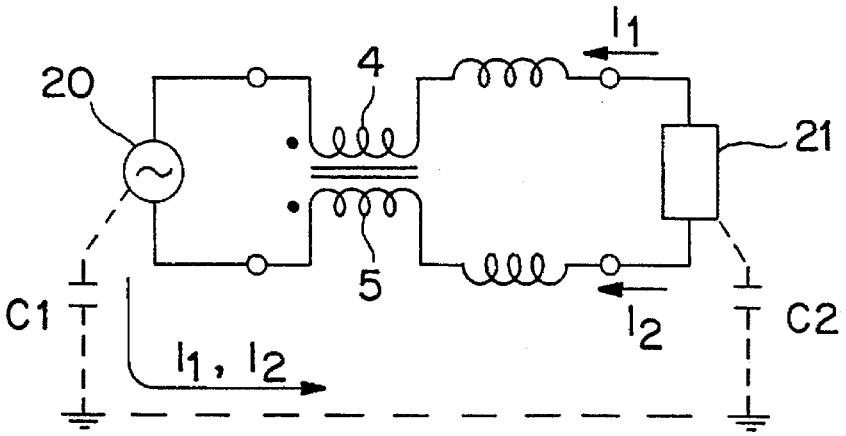
FIG. 6 illustrates an electric circuit, showing the manner in which the choke coil of FIG. 1 eliminates a common mode noise.
Figure 7:
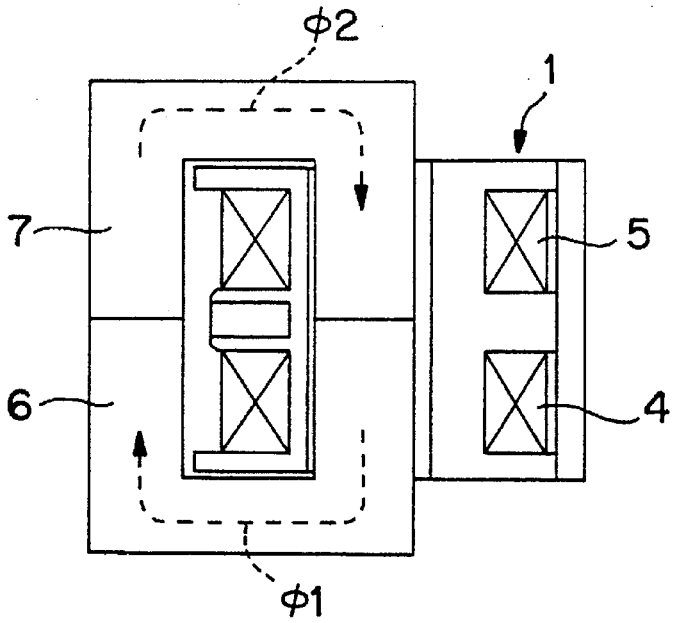
FIG. 7 illustrates a magnetic circuit, showing the manner in which the choke coil of FIG. 1 eliminates a common mode noise.

FIGS. 6 and 7 shows the manner in which the choke coil eliminates a common mode noise.

Referring to FIG. 6, the choke coil is electrically connected to a source of power 20 and a load or electronic device 21 through two signal lines. A floating capacity C1 occurs between the power source 20 and the ground, whereas a floating capacity C2 occurs between the load 21 and the ground. When common mode noise currents $i_1$ and $i_2$ flow through the two signal lines in the direction indicated by the arrows in FIG. 6, magnetic fluxes $\phi 1$ and $\phi 2$ are generated in the windings 4 and 5 as shown in FIG. 7. These magnetic fluxes $\phi 1$ and $\phi 2$ are then combined while they are circulating through the closed magnetic circuits. The magnetic fluxes $\phi 1$ and $\phi 2$ are free from leakage, and their magnitude gradually decreases. This is because the magnetic fluxes $\phi 1$ and $\phi 2$ are converted into thermal energy typically in the form of eddy current loss. The attenuation of the common mode noise currents $i_1$ and $i_2$ results.

Figure 8:
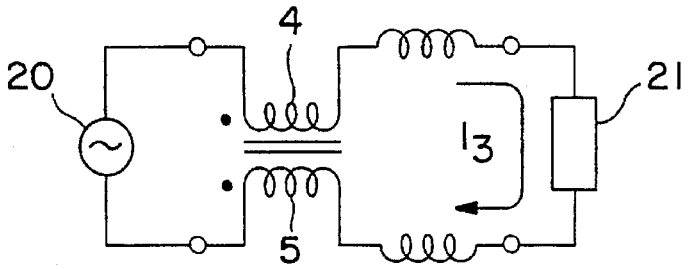
FIG. 8 illustrates an electric circuit, showing the manner in which the choke coil of FIG. 1 eliminates a normal mode noise.
Figure 9:
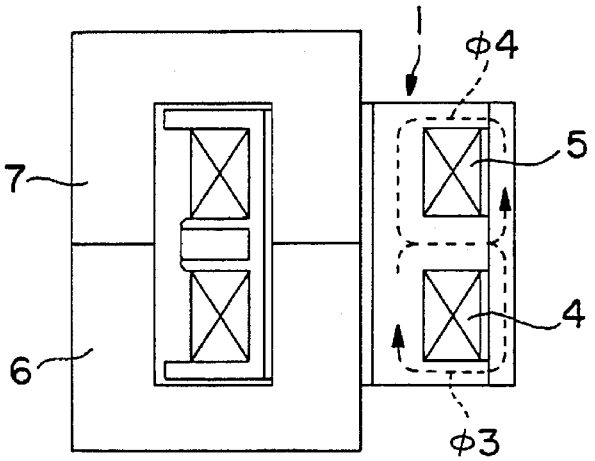
FIG. 9 illustrates a magnetic circuit, showing the manner in which the choke coil of FIG. 1 eliminates a normal mode noise.

FIGS. 8 and 9 shows the manner in which the choke coil eliminates a normal mode noise.

When a normal mode noise current $i_3$ flows through the two signal lines in the direction of the arrow as shown in FIG. 8, magnetic fluxes $\phi 3$ and $\phi 4$ are generated in the windings 4 and 5 as shown in FIG. 9. These magnetic fluxes $\phi 3$ and $\phi 4$ are free from leakage. While the magnetic fluxes $\phi 3$ and $\phi 4$ are circulated through the closed magnetic paths of the bobbin 1, they are converted into thermal energy typically in the form of eddy current loss, and its magnitude gradually decreases. The attenuation of the normal mode noise current $i_3$ results.

The present invention is not limited to the previous embodiment. Various modifications may be made within the scope of the invention.

The cover is not necessarily U-shaped, and may be formed by a method such as molding ferrite. The cover may be a member for forming a closed magnetic circuit of a normal mode noise.

Figure 10:
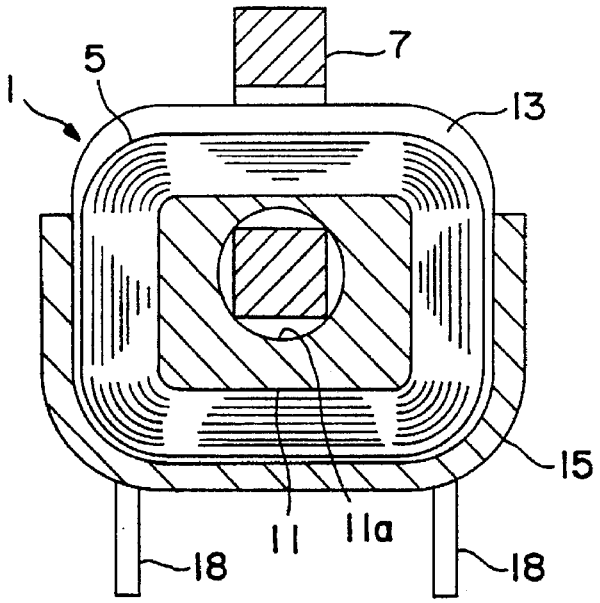
FIG. 10 is a sectional view of another embodiment.

Illustratively, one side of each of the magnetic cores 6 and 7 inserted into the bobbin 1 has a circular cross-section. Alternatively, it may have a rectangular cross-section as shown in FIG. 10. It may also have a triangular or any other polygonal cross-section.

The central collar 14 may or may not have a groove of any shape. Also, the central collar 14 may have a thickness more than twice greater than the thickness of the other, end collars 12 and 13.

Illustratively, the magnetic cores 6 and 7 have a C shape. Alternatively, they may have an E shape or one of the magnetic cores may have a C or E shape, and the other magnetic core may have an I shape. The magnetic core may be formed in one-piece rather than two-piece, in such a case, the single magnetic core may have a ladder or rectangular shape.

A choke coil according to another embodiment of the present invention will also be described with reference to the accompanying drawings.

Figure 11:
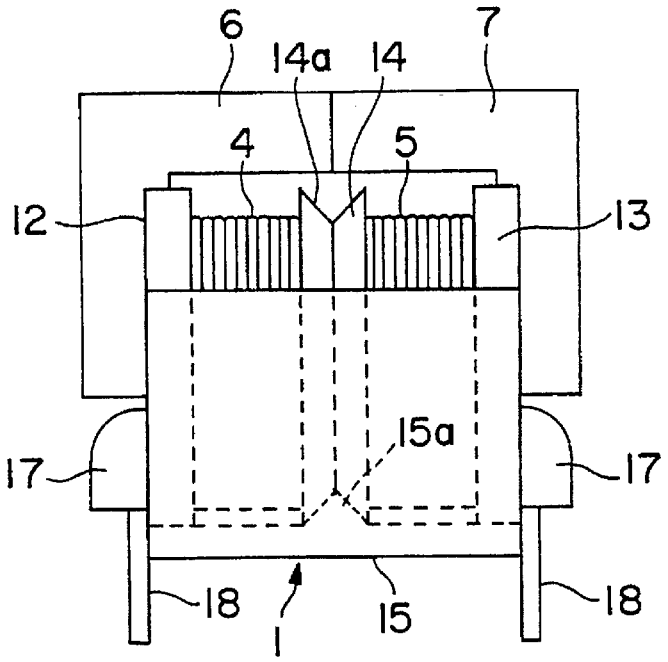
FIG. 11 is a front view of a choke coil according to another embodiment of the present invention.
Figure 12:
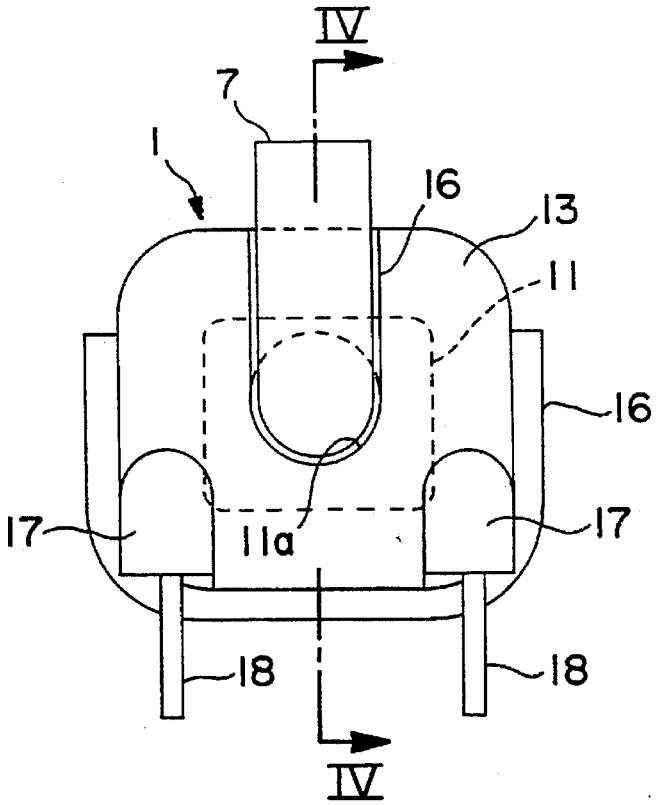
FIG. 12 is a side view of the choke coil shown in FIG. 11.

Referring to FIGS. 11 and 12, a choke coil includes a bobbin 1, a pair of windings 4 ant 5 wound around the bobbin 1, and two C-shaped magnetic cores 6 and 7.

The bobbin 1 includes a barrel 11 with three collars, that is, a central collar 14 and two opposite end collars 12 and 13, and a cover 15 attached to one end of the collars 12 to 14. The barrel 11 has a rectangular cross-section and is designed to maximize its cross-sectional area within the limited size of the choke coil.

The barrel 11 has a hole 11*a*. The hole 11*a* has a circular cross-section, but not limited thereto. It may alternatively have a rectangular cross-section. A magnetic core guide slot 16 is formed in the upper portion of each of the end collars 12 and 13. Terminal mounts 17 are attached to the lower portion of the end collars 12 and 13. Terminals 18 have a parts embedded in the terminal mounts 17.

Figure 13:
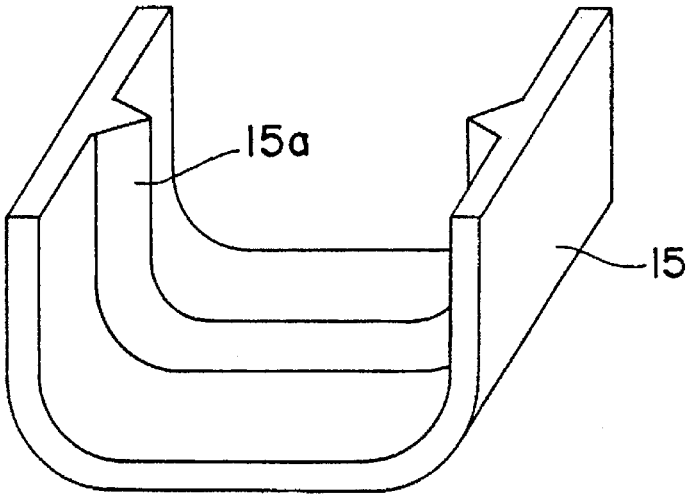
FIG. 13 is a perspective view of a bobbin cover for use in the choke coil shown in FIG. 11.

A V-shaped groove 14*a* is formed in the outer periphery of the central collar 14. As shown in FIG. 13, a cover 15 has a U cross-section. The cover 15 is adhesively attached or otherwise secured to the outer periphery of the end collars 12 to 14 after the windings 4 and 5 have been wound around the barrel 11. The cover 15 has a V-shaped projection 15*a* which is received within the groove 14*a* of the central collar 14.

The bobbin 1 is made of an insulating magnetic material, specifically, a ferrite material such as Ni—Zn and a dust core. The relative permeability of the material is at least one (preferably, 2 to a few hundred).

The pair of windings 4 and 5 are wound around the bobbin 1 at opposite sides of the collar 14 and have respective leading and tail ends connected to the terminals 18.

The magnetic cores 6 and 7 extend through the hole 11*a* of the barrel 11 and are interconnected together. The magnetic cores 6 and 7 have a C shape. The magnetic cores 6 and 7 are guided by the magnetic core guide slots 16 and oriented in a vertical direction. The cover 15 is attached to one side of the end collars 12 to 14 opposite to the guide slots 16 for the magnetic cores 6 and 7 and contacted with three-fourths of the entire surface of the collars 12 to 14. The magnetic cores 6 and 7 are made of a ferrite or amorphous material whose relative permeability is preferably two to three thousand. An insulating cover may be attached to the cores 6 and 7 as the case may be.

The choke coil of this embodiment will be described in more detail with reference to FIG. 14.

The collar 14 is provided at its outer periphery with the groove 14*a*, whereas the cover 15 is provided with the corresponding projection 15*a*. The creeping distance L between the windings 4 and 5 is measured along the inclined surfaces of the groove 14*a*. When one of the inclined surfaces is represented by C, the creeping distance L is approximately the product of 2 times C. Accordingly, the distance between the windings 4 and 5 with the groove 14*a* is longer than that between the windings 4 and 5 without the groove 14*a*. The provision of the groove thus increases resistance to insulation of the choke coil.

The choke coil may instead be made smaller. Specifically, a choke coil is typically required to provide a creeping distance of at least 3.2 mm for safety purpose. To satisfy this requirement, a conventional choke coil has a high collar. Advantageously, the groove 14*a* increases the creeping distance between the windings 4 and 5 to at least 3.2 mm without increasing the height of a collar. Engagement of the groove 14*a* and the projection 15*a* allows for smooth guidance of the cover 15 and facilitates positioning of the cover 15 when the cover 15 is joined to the outer periphery of the collars 12 to 14.

Figure 14:
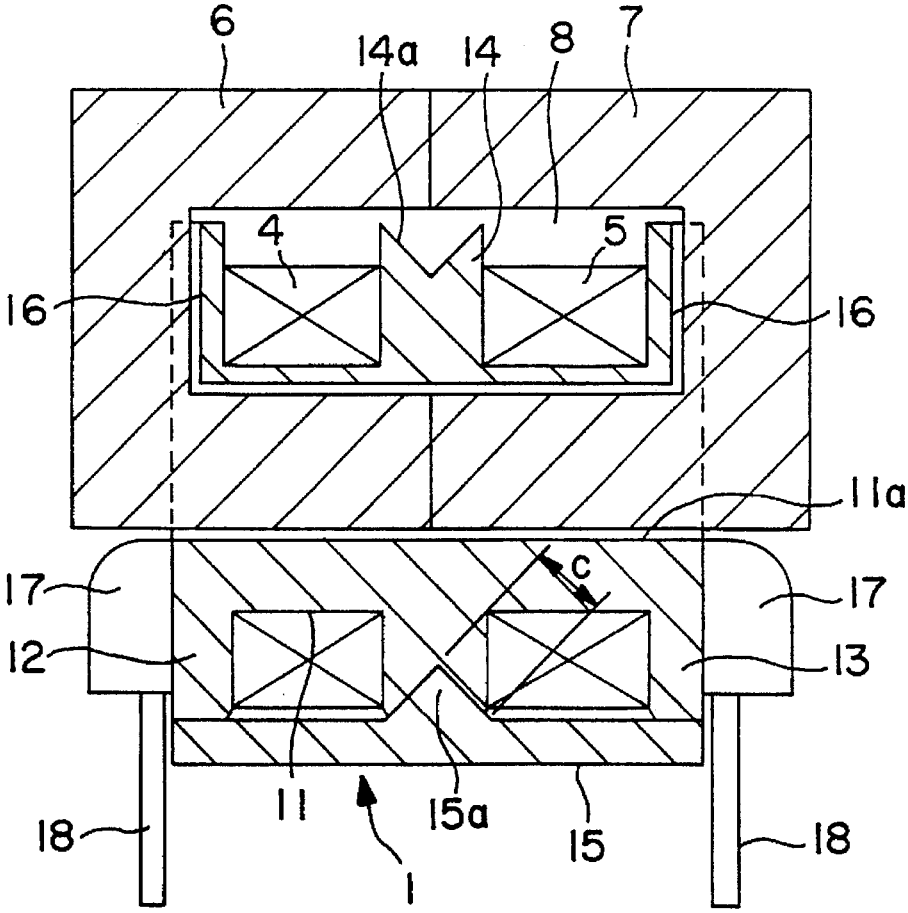
FIG. 14 is a sectional view taken on the line IV—IV of FIG. 12.
Figure 15:
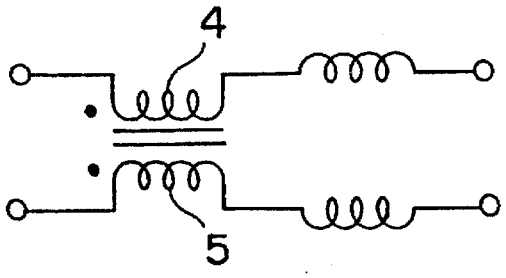
FIG. 15 illustrates an electric equivalent circuit for use in the choke coil shown in FIG. 11.

Referring to FIG. 14, the left half of the bobbin 1, the left end collar 12, the left half of the cover 15, and the central collar 14 collectively form a closed magnetic circuit around winding 4. The right half of the bobbin 1, the right end collar 13, the right half of the cover 15, and the central collar 14 collectively form another closed magnetic circuit around the winding 5. FIG. 15 shows an electric equivalent circuit for use in this choke coil.

Figure 16:
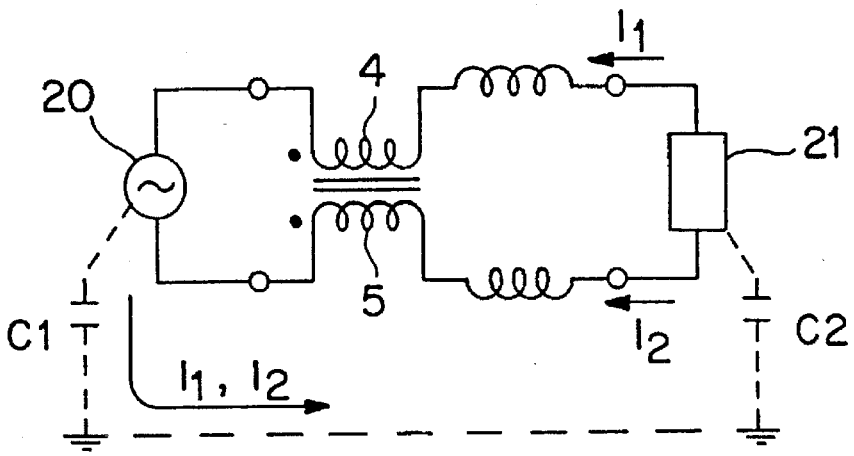
FIG. 16 illustrates an electric circuit, showing the manner in which the choke coil of FIG. 11 eliminates a common mode noise.
Figure 17:
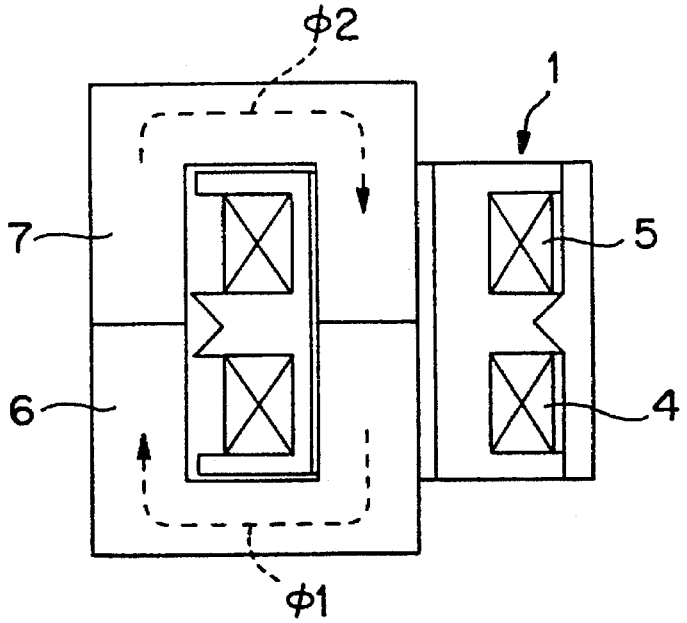
FIG. 17 illustrates a magnetic circuit, showing the manner in which the choke coil of FIG. 11 eliminates a common mode noise.

FIGS. 16 and 17 shows the manner in which the choke coil eliminates a common mode noise.

Referring to FIG. 16, the choke coil is electrically connected to a source of power 20 and a load or electronic device 21 through two signal lines. A floating capacity C1 occurs between the power source 20 and the ground, whereas a floating capacity C2 occurs between the load 21 and the ground. When common mode noise currents $i_1$ and $i_2$ flow through the two signal lines in the direction indicated by the arrows in FIG. 16, magnetic fluxes $\phi 1$ and $\phi 2$ are generated in the windings 4 and 5 as shown in FIG. 17. These magnetic fluxes $\phi 1$ and $\phi 2$ are then combined while they are circulating through the closed magnetic circuit. The magnetic fluxes $\phi 1$ and $\phi 2$ are free from leakage, and their magnitude gradually decreases. This is because the magnetic fluxes $\phi 1$ and $\phi 2$ are converted into thermal energy typically in the form of eddy current loss. The attenuation of the common mode noise currents $i^1$ and $i_2$ results.

Figure 18:
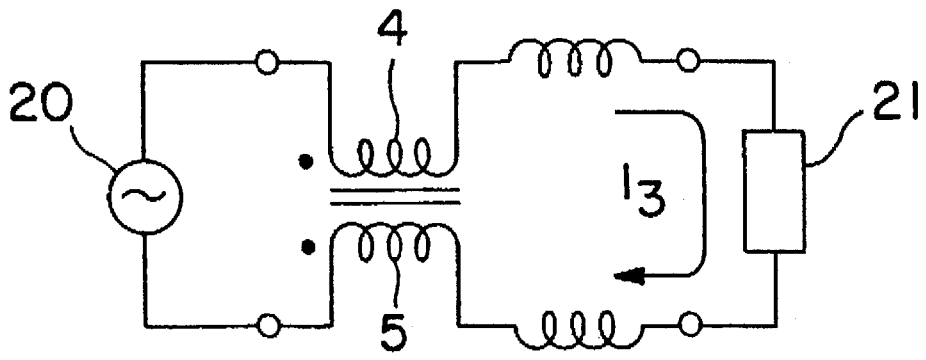
FIG. 18 illustrates an electric circuit, showing the manner in which the choke coil of FIG. 11 eliminates a normal mode noise.
Figure 19:
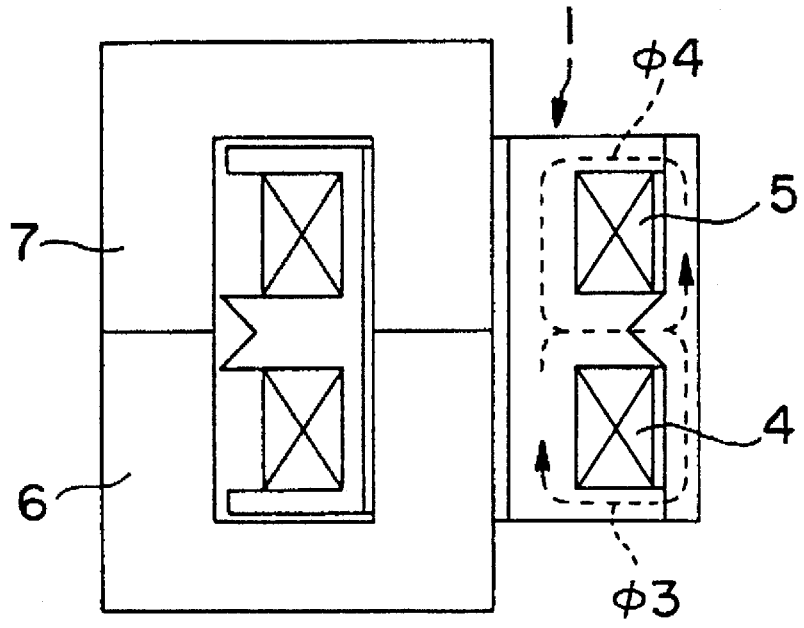
FIG. 19 illustrates a magnetic circuit, showing the manner in which the choke coil of FIG. 11 eliminates a normal mode noise.

FIGS. 18 and 19 shows the manner in which the choke coil eliminates a normal mode noise.

When a normal mode noise current $i_3$ flows through the two signal lines in the direction of the arrow as shown FIG. 18, magnetic fluxes $\phi 3$ and $\phi 4$ are generated in the windings 4 and 5 as shown in FIG. 19. These magnetic fluxes $\phi 3$ and $\phi 4$ are free from leakage. While the magnetic fluxes $\phi 3$ and $\phi 4$ are circulated through the closed magnetic circuits of the bobbin 1, they are converted into thermal energy typically in the form of eddy current loss, and it magnitude gradually decreases. Attenuation of the normal mode noise current $i_3$ results. The choke coil is thus effective to eliminate both normal and common mode noises.

The present invention is not limited to the previous embodiments. Various modifications may be made within the scope of the invention.

The cover is not necessarily U-shaped, and may be formed by a method such as molding ferrite. The cover may be a member for forming a closed magnetic circuit of a normal mode noise.

The groove 14*a* of the central collar 14 may have any shape, for example, U or W shape. In any case, the projection 15*a* of the cover 15 should have a shape engageable with the groove 14*a*.

In the illustrated embodiment, the cover 15 is in contact with three sides of the collars 12 to 14. Alternatively, the cover 15 may be contacted with only one side or two sides, or even all the sides (four sides) of the collars 12 to 14.

The magnetic cores 6 and 7 have a U shape, but may have an E shape. Alternatively, one of the magnetic cores 6 and 7 may have a U or E shape, and the other core may have an I shape. As a further alternative, the magnetic cores may be formed in one-piece rather than two-pieces. Such a single magnetic core may have a ladder or rectangular shape.

It is clear from the foregoing description that the present invention provided a choke coil comprises a pair of windings, a bobbin made of a magnetic material and including closed magnetic circuits extending through the windings, and two magnetic cores inserted into the bobbin. With this arrangement, when a common or normal mode noise current flows through the two windings, the resulting magnetic fluxes are converted into thermal energy due to eddy current loss within the magnetic cores or the bobbin. This decreases the magnitude of the magnetic fluxes and eliminates common or normal mode noise. Advantageously, the magnetic fluxes are free from leakage. This eliminates the need for a magnetic shield around the choke coil.

One side of each magnetic core within the hole of the bobbin has a circular or rectangular cross-section. This reduces the contact area between the magnetic core and the inner wall of the hole and thus, prevents magnetic fluxes generated within the bobbin due to a normal mode noise from leaking from the bobbin and moving toward the magnetic core.

The hole of the barrel is offset from the central axis of the barrel. This arrangement increases the cross-sectional area of a magnetic circuit through which a magnetic flux generated within the bobbin due to a normal mode noise passes. This results in a decrease in magnetic resistance of the magnetic circuit and thus, brings about an increase in a normal mode inductance. Moreover, the bobbin occupies less space within the opening of the magnetic cores. This makes it possible to increase the number of turns of the windings and, thus, normal and common mode inductances.

The central collar has a thickness twice as great as that of the end collars. This increases the cross-sectional area of the magnetic circuits through which magnetic fluxes generated in the both windings due to a normal mode noise pass and thus, the extent of a normal mode inductance.

Also, within the opening of the magnetic cores, the gap between the central collar and the magnetic cores is greater than that between the end collars and the magnetic cores. This configuration prevents magnetic fluxes generated within the bobbin due to a normal mode noise from leaking from the bobbin and moving toward the magnetic cores.

The groove is formed in the outer periphery of the central collar of the bobbin and is shaped to receive the projection of the cover. This arrangement increases the creeping distance between the two windings wound around the barrel at opposite sides of the central collar and improves resistance to insulation. The choke coil may instead be made compact. Engagement of the projection of the cover and the groove allows for smooth guidance of the cover and facilitates positioning of the cover. This engagement thus enables automatic assembly of the choke coil and insures that the bobbin and the cover collectively form closed magnetic circuits.

Accordingly, no saturation of the magnetic fluxes due to a common mode noise results. The present invention thus provides a choke coil which is compact and is effective to substantially eliminates common and normal mode noises.

What is claimed is:

1. A choke coil comprising:

a pair of windings;

a bobbin including:

a barrel around which said pair of windings are wound, said barrel including a hole through which a magnetic core is inserted, two opposite end collars extending beyond and in the same plane as opposite ends of the barrel, a central collar extending around and perpendicular to a central portion of the barrel, a cover for inter-connecting the central collar and two opposite end collars, wherein the bobbin is made of a magnetic material for forming closed magnetic circuits around the pair of windings by the barrel, the collars, and the cover; and said magnetic core for forming a closed circuit having one side inserted into said hole of said barrel.

2. A choke coil according to claim 1, wherein the cross-section of the hole of the barrel is different from the cross-section of the one side of the magnetic core inserted within the barrel, one being a circular cross-section and the other being a rectangular cross-section.

3. A choke coil according to claim 1, wherein said hole of said barrel is offset from the axis of said barrel.

4. A choke coil according to claim 1, wherein the central collar has a thickness at least two times greater than that of the end collars.

5. A choke coil according to claim 1, wherein said magnetic core defines an opening, and wherein within said opening, the gap between the outer periphery of said central collar and said magnetic core is greater then the gap between the outer periphery of said end collars and said magnetic core.

6. A choke coil according to claim 1, wherein said central collar has a groove on its outer periphery, and the cover has a projection, at least part of which is received in said groove.

7. A choke coil according to claim 1, wherein the cross-section of the hole of the barrel is similar to the cross-section of one side of the magnetic core.

* * * * *